United States Patent [19]

Marschka

[11] 4,414,485

[45] Nov. 8, 1983

[54] CONTROL-SCREEN ELECTRODE SUBASSEMBLY FOR AN ELECTRON GUN AND METHOD FOR CONSTRUCTING THE SAME

[75] Inventor: Frank D. Marschka, Lancaster, Pa.

[73] Assignee: RCA Corporation, New York, N.Y.

[21] Appl. No.: 276,264

[22] Filed: Jun. 23, 1981

[51] Int. Cl.[3] ..... H01J 29/46; H01J 9/04

[52] U.S. Cl. ..... 313/451; 313/456; 445/34

[58] Field of Search ..... 313/456, 447, 448, 451; 445/3, 4, 34, 36

[56] References Cited

U.S. PATENT DOCUMENTS

| | | | |
|---|---|---|---|
| Re. 25,127 | 2/1962 | Szegho | 315/16 |
| 2,170,663 | 8/1939 | Painter | 250/163 |
| 2,202,588 | 5/1940 | Kniepkamp | 250/162 |
| 2,275,029 | 3/1942 | Epstein | 250/27 |
| 2,375,815 | 5/1945 | Ohl | 250/162 |
| 2,540,621 | 2/1951 | Johnson | 250/27.5 |
| 2,735,032 | 2/1956 | Bradley | 313/82 |
| 2,825,832 | 3/1958 | Cutler | 313/38 |
| 2,825,837 | 3/1958 | Dudley | 313/82 |
| 2,916,649 | 6/1957 | Levin | 313/456 X |
| 3,004,186 | 10/1961 | Gray | 315/15 |
| 3,032,674 | 5/1962 | Schwartz | 313/82 |
| 3,068,548 | 12/1962 | Hergenrother et al. | 445/34 |
| 3,164,426 | 1/1965 | Benway | 313/82 |
| 3,979,631 | 9/1976 | van der Ven | 313/450 |
| 4,298,818 | 11/1981 | McCandless | 313/417 |
| 4,350,925 | 9/1982 | Marschka | 313/451 |

FOREIGN PATENT DOCUMENTS

| | | |
|---|---|---|
| 457253 | 11/1936 | United Kingdom . |
| 564546 | 10/1944 | United Kingdom . |
| 656617 | 8/1951 | United Kingdom . |

*Primary Examiner*—Palmer C. Demeo
*Assistant Examiner*—Sandra L. O'Shea
*Attorney, Agent, or Firm*—Eugene M. Whitacre; Dennis H. Irlbeck; Vincent J. Coughlin, Jr.

[57] ABSTRACT

The present invention is an improvement in an electron gun for use in a cathode-ray tube. Such a gun includes a cathode assembly and at least two spaced successive electrodes having aligned electron beam apertures therein. The improvement comprises one of the two electrodes having a plurality of alignment apertures disposed around the periphery thereof. A plurality of insulative support assemblies are referenced to the plurality of alignment apertures and interconnected to the one electrode. Each of the support assemblies also includes at least one support plate having a locating portion which is attached to the other electrode. A method is disclosed for aligning the electron beam apertures of the two successive electrodes.

5 Claims, 3 Drawing Figures

CONTROL-SCREEN ELECTRODE SUBASSEMBLY FOR AN ELECTRON GUN AND METHOD FOR CONSTRUCTING THE SAME

BACKGROUND OF THE INVENTION

The present invention relates to an improved control-screen electrode subassembly for an electrostatically-focused electron gun for a cathode-ray tube, CRT, and particularly to an integral control-screen electrode subassembly having improved stability and alignment between two adjacent electrodes.

An electron gun, such as used in a display CRT and a projection kinescope, is designed to generate and direct an electron beam to a small area on the screen of a tube. The electron gun has a cathode assembly and a series of apertured electrodes spaced therefrom. The electrodes are held in place relative to each other by separate attachment to a plurality of glass support rods. Such a structure is shown in U.S. Pat. No. 2,275,029 issued to Epstein on Mar. 3, 1942 and in U.S. Pat. No. 3,004,186 issued to Gray on Oct. 10, 1961. The electrode closest to the cathode assembly is called the G1 and is usually a control grid. The next electrode is called the G2 and is usually a screen grid. The spacing between these two grids is critical for maintaining the operating voltages within the established limits. Furthermore, the G1 and G2 electrode apertures must be precisely aligned in order to provide minimum aberrations from the beam forming region and to ensure alignment with the main lens axis.

In the above-referenced Epstein and Gray patents, the cathode is constructed as a subassembly with a cup-shaped control grid electrode. This subassembly is attached, in an operation called beading, to the glass support rods separately from the screen grid attachment. Since the beading operation is performed at an elevated support rod temperature, the G1 to G2 electrode spacing and aperture alignment may be altered during the subsequent cooling of the support rods. During tube operation, the glass support rods also become heated and expand. Since the support rods are separated from each other, the heating of the rods may be somewhat dissimilar thereby causing a difference in expansion resulting in a variation in electrode spacing and aperture alignment.

U.S. Pat. No. 2,825,837 issued to Dudley on Mar. 4, 1958 shows an electron gun in which the G1 electrode and the G2 electrode are slidably attached to a plurality of steatite support rods and spaced apart by steatite washers disposed between the support flanges of the electrodes. In the Dudley structure, the precision of the electron beam aperture alignment depends upon the accuracy with which the support flanges are attached to the G1 electrode and the tolerances of the steatite support rods as well as the tolerance of the support apertures in the G2 electrode and the G1 support flanges.

U.S. Pat. No. 2,170,663 issued to Painter on Aug. 22, 1939 shows an electron gun structure comprising a plurality of electrodes and insulating spacers compressively retained between flanged discs and welded to a cylindrical electrode. The Painter structure provides accuracy of alignment and of spacing of the various tube parts; however, the Painter structure is complex and expensive.

U.S. Pat. No. 2,375,815 issued to Ohl on May 15, 1945 shows a monolithic electron gun structure comprising a cathode assembly, control electrode and anode attached to an insulating member. The spacing between the control electrode and the anode as well as the aperture alignment is established by precisely forming a pair of steps in the insulating member. The spacing and alignment between the adjacent electrodes depends upon the accuracy with which the step height as well as the step width can be formed. It is well known that precisely-formed insulators, such as ceramics, are expensive. Precisely-formed annular ceramic rings for spacing the control electrode from the adjacent electrode are also used in U.S. Pat. No. 3,979,631 issued to van der Ven on Sept. 7, 1976 and in U.S. Reissue No. 25,127 issued to Szegho on Feb. 20, 1962. In the Szegho reissue patent, a pair of ceramic spacing rings are utilized. One ring, having an accurately-controlled outside diameter and thickness, establishes the G1 to G2 longitudinal spacing while a second ceramic ring, having precisely-formed, concentric inside and outside diameters, provides the lateral spacing and thus the aperture alignment between the electrodes. Such a structure, while apparently simple in construction, is very expensive and therefore impractical.

In U.S. Pat. application, Ser. No. 70,738 of McCandless, filed on Aug. 29, 1979 now U.S. Pat. No. 4,298,818 issued on Nov. 3, 1981, and assigned to the same assignee as the present invention, an improved electron gun is disclosed. The McCandless electron gun comprises a plurality of cathode assemblies attached to one surface of a single, flat ceramic wafer and two electrodes (G1, G2) individually attached to the opposite side of the ceramic wafer. In the McCandless structure, the control grid is brazed to the ceramic wafer along a peripheral rib while the screen grid is brazed to the ceramic wafer at the ends of two parallel flanges. Thus, the spacing between the control grid and the screen grid electrodes is directly related to the height of the peripheral rib and the length of the flanges since each contacts the same surface of the ceramic wafer. The McCandless structure thus transfers the cost and precision from the ceramic member to the two-tool formed metal parts.

SUMMARY OF THE INVENTION

The present invention is an improvement in an electron gun for use in a cathode-ray tube. Such a gun includes a cathode assembly and at least two spaced successive electrodes having aligned electron beam apertures therein. The improvement comprises one of the two electrodes having a plurality of alignment means disposed around the periphery thereof. A plurality of insulative support assemblies are referenced to the plurality of alignment means and are interconnected to the one electrode. Each of the support assemblies also includes at least one support plate having a locating portion which is attached to the other electrode.

DETAILED DESCRIPTION

Figure 1:
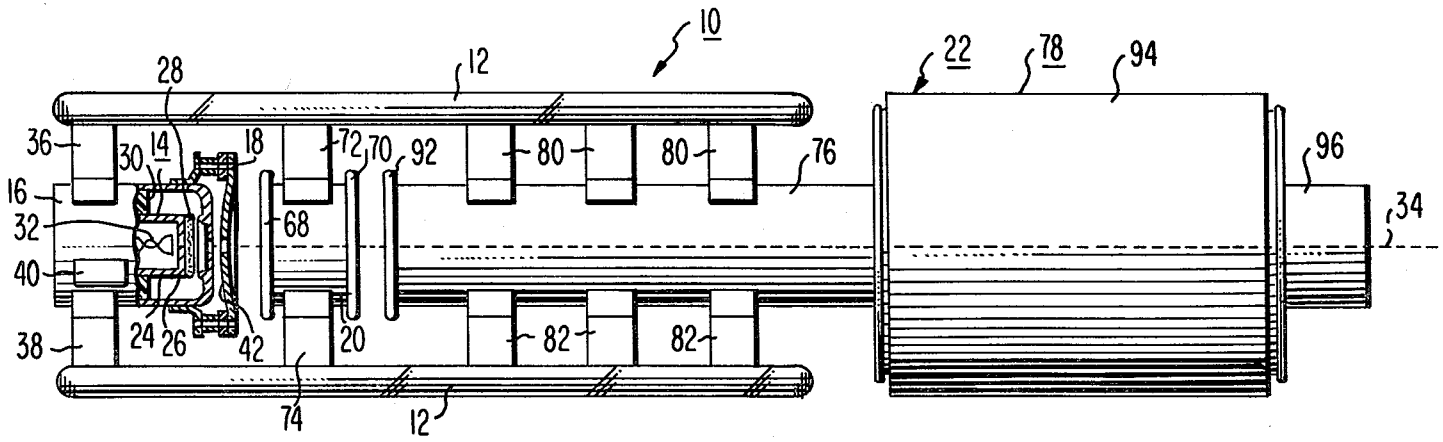
FIG. 1 is a partially cutaway side view of an electron gun constructed in accordance with the present invention.
Figure 3:
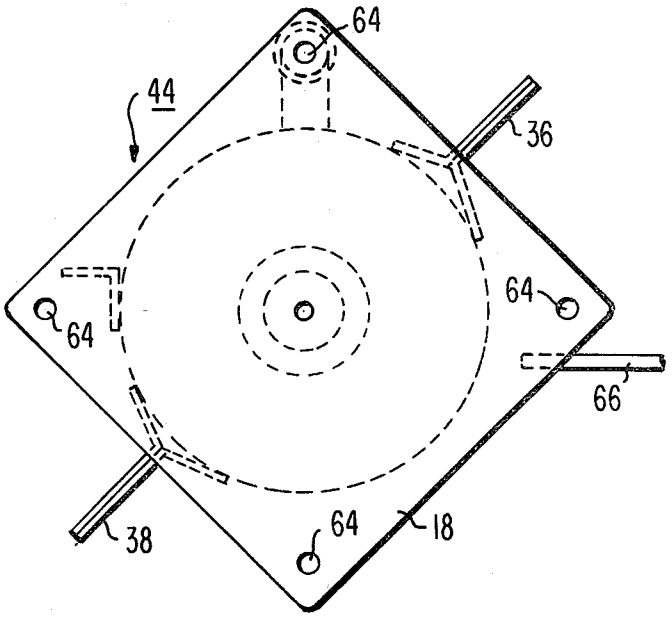
FIG. 3 is a view along line 3—3 of FIG. 2.
Figure 2:
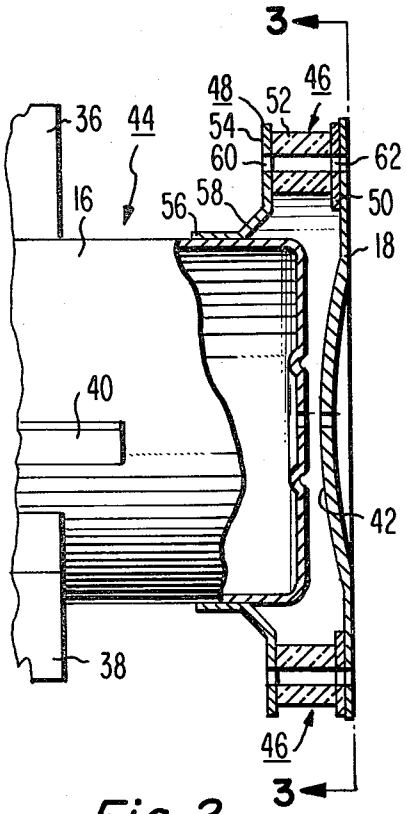
FIG. 2 is an enlarged view of a control-screen electrode subassembly.

The details of an improved electron gun 10 are shown in FIGS. 1 through 3. The gun 10 comprises two glass support rods 12, also called beads, upon which various electrodes of the gun are mounted. These electrodes include, serially, in the order mentioned, a cathode assembly 14, a control grid electrode 16, a screen grid electrode 18, a first accelerating electrode 20 and a main lens assembly 22.

The cathode assembly 14 is conventional and may comprise a cathode sleeve 24 closed at the forward end by a cap 26 having an electron emissive coating 28 thereon. The cathode sleeve 24 is supported within the control electrode 16 and spaced therefrom by an insulating member 30. The structural connections between the insulating member 30 and the cathode assembly 14 and the control electrode 16 are well known in the art and are not shown for simplicity. The cathode is indirectly heated by a heater coil 32 positioned within the sleeve 24. Electrical connections to the coil 32 are provided by connectors (not shown) in a manner well known in the art.

The control and screen electrodes 16 and 18, respectively, are two closely-spaced elements having aligned electron beam apertures centered with the cathode coating 28 along a reference axis 34 of the electron gun. The control electrode 16 is a cup-shaped member attached to the support beads 12 by a pair of mounting straps 36 and 38. An electrical terminal 40 is provided on the outside surface of the control electrode 16 to apply a potential to the control electrode from an external source (not shown). The screen electrode 18 is an essentially flat plate having a dome-shaped central portion 42 which extends toward the control electrode 16 and provides resistance to thermal expansion during tube operation.

The control and screen electrodes 16 and 18 are constructed as a separate subassembly 44, as shown in FIG. 2. A plurality of insulative support assemblies 46 interconnect the control electrode 16 and the screen electrode 18. Each of the support assemblies 46 comprise a first support plate 48, a second support plate 50 and a ceramic member 52 disposed between the support plates and bonded thereto, for example by a ceramic-to-metal braze. The first support plate 48 comprises a strip of metal, such as Kovar, having a substantially flat sealing portion 54, a locating portion 56 and a bridging portion 58 connecting the sealing portion and the locating portion. A first reference aperture 60 having a diameter of about 1.27 mm (millimeters) is formed in the sealing portion 54 of the first support plate 48. The second support plate 50 comprises a substantially flat metal disc, such as Kovar, having a centrally-disposed second reference aperture 62 with a diameter of about 1.27 mm therethrough. The insulative member 52 comprises a high alumina ceramic having an alumina content of at least 95 percent. The member 52 may be formed from a hollow alumina cylinder having an outside diameter of about 2.54 mm, an inside diameter of about 1.27 mm and a length of about 1.78 mm. The ends of the ceramic member 52 are metallized by the method disclosed in U.S. Pat. No. 3,290,171 issued to Zollman et al., on Dec. 6, 1966 and incorporated herein for purpose of disclosure. The support assemblies 46 are formed by brazing together the stacked components with the reference apertures 60 and 62 aligned coaxially about the inside diameter of the ceramic member 52.

As best shown in FIG. 3, a plurality of alignment apertures 64 having a diameter of about 1.27 mm are formed around the flat periphery of the screen electrode 18. The apertures 64 are positioned so that when the reference apertures 60, 62 of the insulative support assemblies 46 are aligned with the alignment apertures 64, the locating portions 56 of the support assemblies 46 fall on the circumference of a circle having a diameter equal to the outside diameter of the control electrode 16. A connecting strap 66 is attached to the peripheral surface of the screen electrode 18 which is directed toward the control electrode 16. The connecting strap 66 is used to supply operating potential from an external source (not shown) to the screen electrode 18.

In the assembly of the control-screen electrode subassembly 44, the control electrode 16 and the screen electrode 18 are graded by electron beam aperture size into five categories. Matched pairs of control and screen electrodes selected from the same beam aperture size categories are assembled in the following manner. A jigging fixture (not shown) aligns the reference apertures 60, 62 of the insulative support assemblies 46 with the alignment apertures 64 of the screen electrode 18. The support assemblies 46 are attached to the flat periphery of the dome-shaped side of the screen electrode 18, for example by welding the second support plate 50 to the screen electrode. A beam aperture alignment pin (not shown) having a diameter designed to accommodate the graded electron beam apertures of the control electrode 16 and the screen electrode 18 is used to align the beam apertures on the jigging fixture. A spacing shim (not shown) is disposed between the control electrode and the screen electrode to establish the desired predetermined interelectrode spacing. In the preferred embodiment, a 0.254 mm thick shim is used to set the G1–G2 interelectrode spacing. Next, with the beam apertures aligned, the locating portions 56 of the support assemblies 46 are attached, for example by welding, to the side of the cup-shaped control electrode 16. The beam aperture alignment pin and the spacing shim are then removed from the cathode-screen electrode subassembly 44. Subassemblies fabricated as described above provide a concentricity between beam apertures within 0.0051 mm TIR. Since a spacing shim is used to fix the distance between the control and screen electrodes 16 and 18, respectively, the distance is independent of variations in the electrodes 16 and 18 or in the support assemblies 46.

The cathode assembly 14 is inserted into the control electrode 16 with a spacing shim disposed between the control electrode 16 and the screen electrode 18. The spacing shim prevents any change in the interelectrode distance during the cathode insertion operation.

The first accelerating electrode 20 comprises an annular ring having rolled edges 68, 70 at the ends thereof. A pair of mounting straps 72 and 74 attach the accelerating electrode 20 to the support beads 12.

The main lens assembly 22 comprises a tubular-shaped lower focus electrode member 76 and a main lens structure 78. The lower focus member 76 is attached to one end of the main lens 78, for example by welding, and to the support beads 12 by a plurality of mounting straps 80 and 82 embedded in the support beads. The end of the lower focus member adjacent to the accelerating electrode 20 has a rolled edge 92 spaced from the rolled edge 70 of the accelerating electrode 20. The main lens structure 78 is described in copending U.S. Pat. application, Ser. No. 167,050 of Marschka, filed on July 9, 1980 , now U.S. Pat. No. 4,350,925 issued on Sept. 21, 1982 and assigned to the same assignee as the present invention. The Marschka application is incorporated by reference for disclosure purpose. The main lens structure 78 includes a pair of spaced-apart thimble electrodes (not shown) comprising a focusing electrode and an anode disposed concentrically within a ceramic cylinder 94. A tubular anode extension 96 is attached, for example by welding, to the other end of the main lens structure 78.

It should be noted that the present invention centers around the subassembly 44 and that the remainder of the gun can vary greatly from that shown. For example, the focusing portion of the gun may be as shown in the copending Marschka patent application referenced above which shows a single focusing electrode between the screen electrode and the main lens structure.

The presently disclosed gun construction, where the control and screen electrodes are constructed as a single subassembly secured together by a plurality of ceramic support assemblies, offers considerable advantages over prior art electron gun construction. In most prior art electron guns, each component is separately attached to the glass support rods and therefore subjected to the heat required to soften the rods during assembly of the parts. In the present embodiment, the control-screen electrode subassembly is attached to the glass support rods by mounting straps attached only to the end of the control electrode remote from the screen electrode. Because of this, none of the subassembly components is distorted as may occur in prior art tubes, thus electron beam aperture alignment is maintained. Also, since the screen electrode is not independently attached to the support rods, as in most prior art tubes, the electrical leakage path along the support rods between the mounting straps support the first accelerating electrode and the mounting straps of the control-screen electrode assembly is increased. In the present tube structure in which the first accelerating electrode operates at +30 kV and the control electrode operates at −100 V, the voltage gradient along the glass rods is 60 volts per mil whereas in the prior art structure in which the screen electrode is attached to the support rods, the voltage gradient is about 100 volts per mil.

What is claimed is:

1. In an electron gun for use in a cathode-ray tube, said gun including a cathode assembly, a control electrode, a screen electrode and at least one other electrode, each of said electrodes having an electron beam aperture therein, said beam apertures being aligned for the passage of an electron beam therethrough, the improvement comprising, said screen electrode having a plurality of control electrode alignment apertures disposed around the periphery thereof, and a plurality of insulative support assemblies, each of said support assemblies including a first support plate and a ceramic member having two ends, said first support plate being bonded to one end of said ceramic member, the other end of said ceramic member being referenced to one of said alignment apertures disposed around the periphery of said screen electrode and interconnected thereto, each of said first support plates including a locating portion being located on a contour defining the outer shape of said control electrode, said locating portions being attached to said control electrode.

2. The electron gun as in claim 1, wherein each of said ceramic members includes a longitudinal channel extending therethrough, each of said channels being coaxially aligned with a different one of said alignment apertures in said screen electrode.

3. The electron gun as in claim 2, wherein each of said insulative support assemblies include a second support plate bonded to the end of the ceramic member opposite the first support plate, each of said first and second support plates having a reference aperture therethrough, said reference apertures being coaxially aligned with said channel in said ceramic member.

4. A method of constructing an integral control-screen electrode subassembly including a control electrode having a centrally-disposed electron beam aperture, a screen electrode having a centrally-disposed electron beam aperture, said screen electrode including a plurality of alignment means disposed around the periphery thereof, and a plurality of insulative support assemblies, each of said support assemblies including at least one support plate having a locating portion, the method comprising the steps of:

referencing each of said support assemblies with a different one of said alignment means disposed around the periphery of said screen electrode, interconnecting one end of said support assemblies to said screen electrode, aligning said electron beam apertures of said screen electrode and said control electrode, spacing said aligned screen electrode and control electrodes a predetermined distance apart, and attaching said support plate locating portions of said support assemblies to said control electrode.

5. In an electron gun for use in a cathode-ray tube, said gun including a cathode assembly, a cup-shaped control electrode, a screen electrode and at least one other electrode, each of said electrodes having an electron beam aperture therein, said beam apertures being aligned for the passage of an electron beam therethrough, the improvement comprising, said screen electrode having a plurality of control electrode alignment apertures disposed around the periphery thereof, and a plurality of insulative support assemblies interconnecting said control electrode and said screen electrode, each of said support assemblies comprising a first support plate and a second support plate with a hollow insulative ceramic cylinder being disposed between said plates and bonded thereto, said first support plate having a locating portion and a sealing portion with a first reference aperture formed in said sealing portion, said second support plate having a second reference aperture therethrough, said reference apertures being mutually aligned with the inside diameter of said ceramic cylinder and with said alignment apertures in said screen electrode, each of said second support plates being fixedly attached to said screen electrode and each of said locating portions of said first support plates being fixedly attached to the side of the cup-shaped control electrode.

* * * * *